United States Patent [19]

Morell

[11] Patent Number: 4,974,853

[45] Date of Patent: Dec. 4, 1990

[54] GOLF BALL

[75] Inventor: Joseph Morell, Annecy, France

[73] Assignee: Salomon S.A., Annesy, France

[21] Appl. No.: 441,874

[22] Filed: Nov. 27, 1989

[30] Foreign Application Priority Data

Nov. 29, 1988 [FR] France ..... 88 15574

[51] Int. Cl.[5] ..... A63B 37/12; A63B 37/14

[52] U.S. Cl. ..... 273/232; 40/327

[58] Field of Search ..... 273/232; 40/327

[56] References Cited

U.S. PATENT DOCUMENTS 4,762,326 8/1988 Gobush ..... 273/232
4,772,026 9/1988 Gobush ..... 273/232
4,844,472 7/1989 Ihara ..... 273/232

FOREIGN PATENT DOCUMENTS 735555 8/1932 France ..... 273/232

*Primary Examiner*—George J. Marlo

[57] ABSTRACT

The present invention relates to golf ball.

In order to improve the indifferent character of the orientation of the ball with respect to the strike, the peripheral surface (2) of it has dimples (115,116) essentially distributed inside 2 groups of 48 elemental surfaces (113,114), identical in the same group and different from one group to the other in the form of spherical right-angle triangles, delimited by 13 equatorial circles (56 to 61, 65 to 67, 108 to 111) of the sphere defining the general shape of the peripheral surface (2) of the ball (3).

9 Claims, 1 Drawing Sheet

GOLF BALL

The present invention relates to a golf ball of the type having a peripheral surface having the general shape of a sphere and a plurality of dimples arranged in the said peripheral surface and distributed on the latter in accordance with at least one repetitive motif, at least essentially inside elemental spherical surfaces defined by sub-division of the said peripheral surface along arcs of circles centered on the center of the sphere and mutually connecting points of the peripheral surface corresponding to points determined by a cube inscribed in the sphere.

A golf ball of this type is described in French patent No. 735,555, and more precisely with reference to FIGS. 14 to 18 of this document; with reference to these figures, this latter recommends the sub-division of each of the six faces of the cube into four principal triangles of which each is divided into 9, or 16, or 60 triangles determining the positions of the dimples.

This known mode of sub-division of the peripheral surface of a golf ball has an inconvenience in that the behavior of the latter in its trajectory is narrowly tied to the orientation of the ball with respect to the strike; in effect, even if the dimples are arranged with the same motif in the 24 elemental surfaces, in spherical triangular form, resulting from the sub-division of each of the faces of the cube into four principal triangles, the probability of successive strikes hitting the peripheral surface of the ball in its zones having different geometries is significant; in other words, unless great care is taken in the positioning of the ball before the strike, in a manner difficult to practically envisage, a ball having the distribution of dimples recommended with reference to FIGS. 14 to 18 of French patent No. 735,555 will not lend itself to suitable reproducibility of strikes, and consequently of trajectories.

The object of the present invention is to remedy this inconvenience by proposing, also from a cube inscribed inside the sphere, a finer sub-division of the surface of this, in order to increase the homogeneity of distribution of the dimples and consequently to obtain a characteristic as indifferent as possible to the orientation of the ball with respect to the strike.

To this end, the ball of the invention, of the type indicated in the preamble, is characterized in that the sub-division is carried out along:

6 equatorial circles of which each is centered on an axis passing through the respective mid-points of two diametrically opposed edges of the cube and passes through 4 apices of the latter, 3 equatorial circles of which each is centered on an axis passing through the respective centers of two diametrically opposed faces of the cube and passes through the radial projections, onto the sphere, of respective mid-points of 4, mutually parallel, edges of the cube, 4 equatorial circles of which each is centered on an axis passing through 2 diametrically opposed apices of the cube and passes through the radial projections, onto the sphere, of respective mid-points of 6 edges, perpendicular in pairs, of the cube, in a manner to define 48 first identical elemental surfaces and 48 second elemental surfaces identical to each other but different from the first elemental surfaces, the said first and second elemental surfaces being of spherical right-angle triangle form.

The dimples are preferably distributed according to an identical motif in the identical elemental surfaces although the scope of the invention will not be departed from by providing several motifs preferably arranged in a manner regularly distributed on the sphere.

It can easily be envisaged that such a sub-division into 96 elemental surfaces distributed in 2 groups of 48 identical elemental surfaces considerably increases the homogeneity of distribution of the dimples on the peripheral surface of the ball and consequently the probability of an identical relative orientation of a dimple and of the strike for successive strikes, that is to say the indifferent character of the orientation of the ball with respect to the strike.

Particularly for reasons of ease of manufacture, it is preferred that at least one determined equatorial circle, amongst the said equatorial circles, cuts none of the dimples; this determined circle can correspond to a joint plane when the ball is manufactured by assembly of two identical halves or when at least one surface layer of it, including the dimples, is made by molding in a single piece in a mold itself formed of two assembled identical halves; taking account of the fine sub-division of the peripheral surface of the ball and of the homogeneity of distribution of the dimples which results, one can then allow one of the halves of the ball or of the mold, respectively, possibly to be angularly displaced with respect to the other half about the axis of the said determined equatorial circle; in this case, the said determined equatorial circle sub-divides each of the other said equatorial circles into two circular arcs, of which each corresponds to one of two hemispheres defined by the said determined equatorial circle, and the circular arcs of one of the hemispheres are angularly displaced, with respect to the respectively corresponding circular arcs of the other of the hemispheres, by the same amount about the axis of the said determined equatorial circle; the fact of allowing such a disposition considerably eases the manufacture of the ball by assembly of two halves or by molding in a mold formed of two assembled halves, because it is not necessary to perform a precise adjustment of the relative angular position of the two halves of the ball or of the mold, respectively, in manufacture of the ball.

Other characteristics and advantages of a ball according to the present invention will appear from the description below, relating to two non-limitative embodiments, as well as from the accompanying drawing which forms an integral part of this description.

Figure 1:
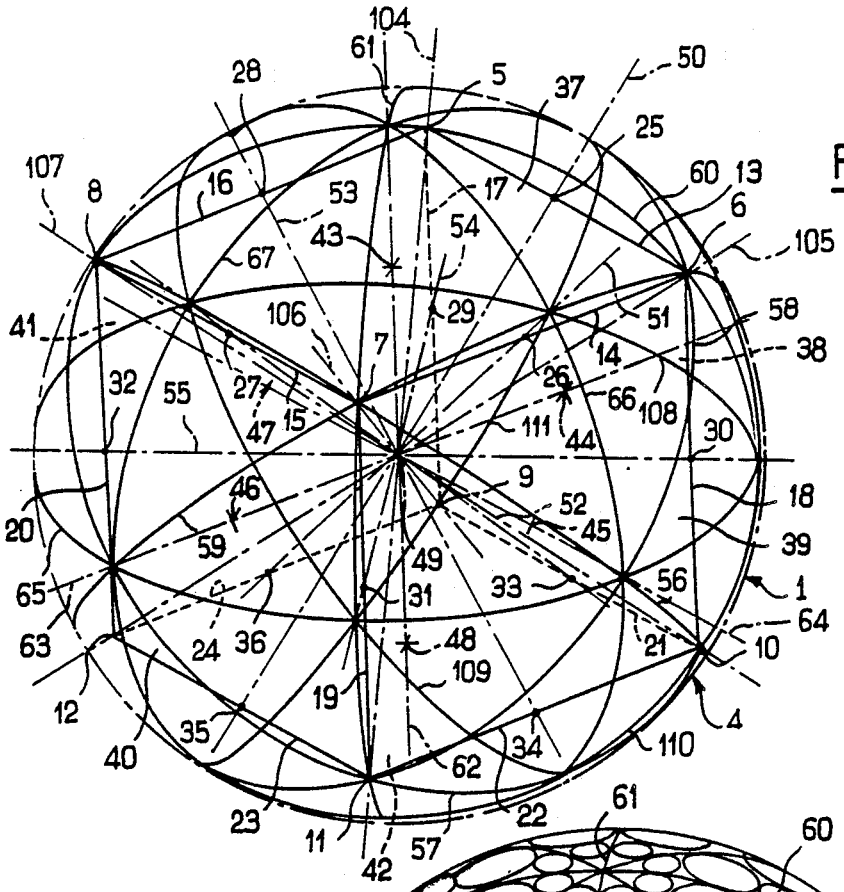
FIG. 1 illustrates the construction on the sphere, in accordance with the present invention, of 13 equatorial circles delimiting 96 elemental surfaces in spherical right-angle triangle form, distributed in two groups of 48 identical elemental surfaces.
Figure 2:
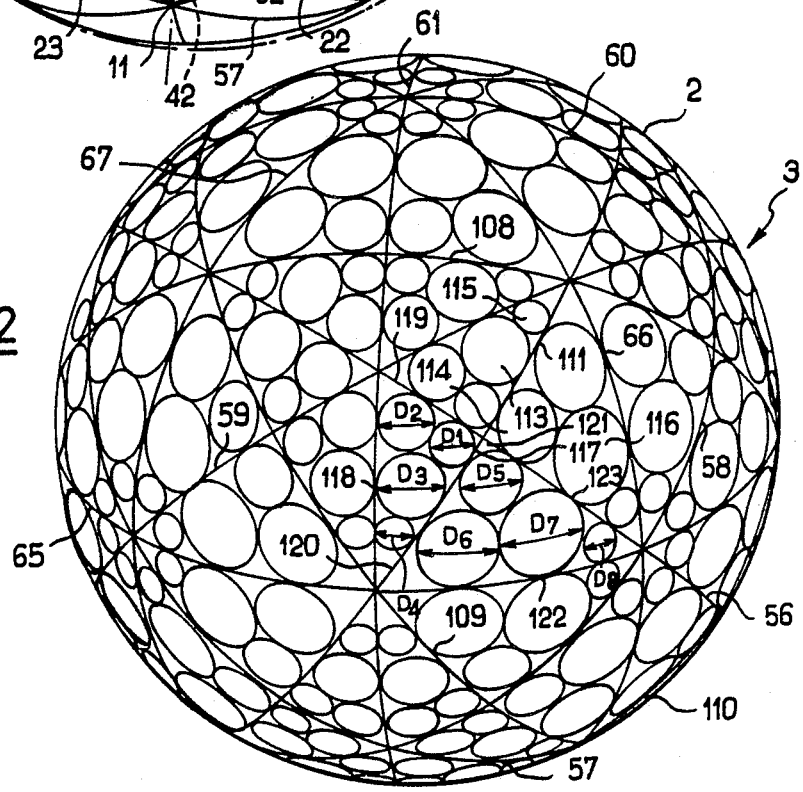
FIG. 2 shows a golf ball of which the dimples are distributed inside the identical elemental surfaces thus defined.

Referring in the first place to FIG. 1 where there is designated by 1 a sphere producing the general shape of the peripheral surface 2 of a golf ball 3 illustrated in FIG. 2, and by 4 a cube inscribed in this sphere 1 on which there are 8 apices 5 to 12 connected in pairs by 12 edges 13 to 24 of which each has a mid-point 25 to 36 and which, in fours, define six square faces 37 to 42 of which each has a center 43 to 48; the cube 4 itself and the sphere 1 have a common center 49 which will serve as a reference when reference is made below to the concept of diametrically opposed positions or of radial projection.

For geometrical reasons, the edges 13 to 24 of the cube 4 are distributed in 6 groups of two mutually parallel, diametrically opposed edges, that is to say edges 13 and 23, 14 and 24, 15 and 21, 16 and 22, 17 and 19, 18 and 20 of which the respective mid-points also occupy diametrically opposed positions; in accordance with the present invention, by means of the respective mid-points of two edges also diametrically opposed, axes are determined, that is to say the axis 50 passing through the mid-points 25 and 35, the axis 51 passing through the mid-points 26 and 36, the axis 52 passing through the mid-points 27 and 33, the axis 53 passing through the mid-points 28 and 34, the axis 54 passing through the mid-points 29 and 31, and the axis 55 passing through the mid-points 30 and 32; around 6 of the axes thus determined, in a plane (not referenced) perpendicularly cutting this axis at the center 49 of the cube 4 and of the sphere 1, is traced on this sphere 1 an equatorial circle passing through 4 apices of the cube, that is to say the circle 56 having the axis 50, passing through the apices 7,8,9,10, the circle 57 having the axis 51, passing through the apices 5,10,11,8, the circle 58 having the axis 52, passing through the apices 5,6,11,12, the circle 59 having the axis 53, passing through the apices 6,7,12,9, the circle 60 having the axis 54, passing through the apices 6,10,12,8 and the circle 61 having the axis 55, passing through the apices 5,9,11,7; these six circles 56 to 61 are also represented on the peripheral surface 2 of the ball 3 in FIG. 2, but it will be noted that it is not necessary for these circles to be materially reproduced on this surface 2.

Also for geometrical reasons, the respective centers of two diametrically opposed faces of the cube 4 are divided into three groups of two diametrically opposed centers, that is to say centers 43 and 48, 44 and 46, 45 and 47; in accordance with the present invention, there is defined by the two centers of each of these groups an axis, respectively 62,63,64, and about this axis there are described on the sphere respective equatorial circles 65,66,67; the circle 65 with the axis 62 cuts the circles 57,59,60 on the axis 63, that is to say in the region of radial projections onto the surface of the sphere of centers 44 and 46 of the faces 38 and 40; the circle 66 cuts the circles 56 and 58 as well as the circle 65 on the axis 64, that is to say in the region of radial projections onto the sphere of the centers 45 and 47 of the faces 39 and 41; the circle 67 with the axis 64 cuts the circles 60 and 61 as well as the circle 66 on the axis 62, that is to say in the region of the radial projections onto the sphere of the centers 43 and 48 of the faces 37 and 42.

The three equatorial circles 65,66,67 have been represented on the peripheral surface 2 of the ball 3 in FIG. 2, although they need not necessarily be reproduced on this latter.

It should be noted that, for geometrical reasons, each of the nine equatorial circles 56 to 61 and 65 to 67 defines by its own plane (not referenced) a plane of symmetry for the eight other equatorial circles.

FIG. 1 also shows the presence of 4 supplementary axes 104,105,105,107 of which each passes through two diametrically opposed apices of the cube 4, that is to say respectively the apices 5 and 11, 6 and 12, 7 and 9, 8 and 10.

About each of these axis 104 to 107 is described, on the sphere, a respective equatorial circle 108,109,110,111; it will be noted that each of these equatorial circles 108,109,110,111 passes through the radial projections, onto the sphere, of the respective mid-points of six edges, in perpendicular pairs, of the cube 4; in other words, the circle 108 cuts at two points each of the three axes 51,52 and 55, the circle 109 cuts at two points each of the three axes 52,53 and 54, the circle 110 cuts at two points each of the three axes 50,53 and 55 and the circle 111 cuts at two points each of the three axes 50,51 and 54.

As also appears on FIG. 2, on the peripheral surface 2 of the ball 3, the four supplementary equatorial circles 108 to 111 thus defined, in common with the nine above-mentioned equatorial circles, need not necessarily be reproduced in material form on this surface 2.

These four equatorial circles define with the nine equatorial circles 56 to 61 and 65 to 67 previously described 96 elemental surfaces in spherical right-angle triangle form, which are distributed in two groups of which each comprises 48 identical elemental surfaces such as, respectively, 113 and 114, the elemental surfaces 113 being identical to each other and smaller than the elemental surfaces 114 themselves identical to each other; it will be noted that two different, immediately neighboring, elemental surfaces 113,114 together make up a spherical right angle triangle, the spherical right-angle triangles thus defined being mutually identical and mutually symmetric with respect to the nine equatorial circles 56 to 61 and 65 to 67.

In the case of an elemental surface 113 the right angle is designated by 117, the hypothenuse by 118, the small side of the right angle 117 by 119 and the large side of the right angle 117 by 120; similarly in the case of an elemental surface 114, the right angle is designated by 121, the hypothenuse by 122, the small side of the right angle 121 by 120 in the case where it is common with the large side of the right angle 117 of a surface element 113, and a large side of the right angle 121 by 123.

In accordance with the present invention, dimples such as 115,116 are distributed in accordance with respectively determined motifs inside the elemental surfaces 113 and inside the elemental surfaces 114, without overlapping any of the equatorial circles in the example illustrated although such an overlapping is permissible to a certain extent; preferably, however, one at least of the equatorial circles cuts none of the dimples such as 115 and 116 to correspond with a joint plane between two halves of the ball if it is made in two halves, or between two halves of a mold intended for the production of the ball, or at least of a surface layer of the latter having the dimples, in a single piece by molding; in a non-illustrated manner, this determined equatorial circle can then sub-divide each of the other equatorial circles into two circular arcs mutually angularly displaced, by the same amount, about the axis of this equatorial circle, which will certainly cause the disappearance of the mentioned symmetries but is not really harmful to the homogeneity of distribution of the dimples such as 115 and 116 on the peripheral surface 2 of the ball 3. Preferably, and without departing from the scope of the present invention in adopting a different arrangement, the motif for distribution of the dimples 115 is identical from one elemental surface 113 to another, as is the motif for distribution of the dimples 116 in the elemental surfaces 114; by way of non-limitative example, there are represented four dimples 115 in the form of part-spherical depressions in each elemental surface 113 and four dimples in the form of part spherical depressions 116 in each elemental surface 114, but this number, the distribution and shape of the dimples for each elemental surface can be different without departing from the scope of the present invention.

More precisely, in the non-limitative illustrated example, the dimples 115 define, by the their intersection with the spherical peripheral surface 2 of the ball of diameter of the order of 42.67 mm, circles distributed in the following manner in each elemental surface 113:

1 circle of diameter $D_1$ of the order of 1.32 mm, positioned in the right angle 117 and approximately tangential to the two sides 119,120 of the right angle 117, 1 circle of diameter $D_2$ of the order of 1.65 mm, approximately tangential to the circle of diameter $D_1$, to the small side 119 of the right angle 117 and to the hypothenuse 118, 1 circle of diameter $D_3$ of the order of 2.00 mm, approximately tangential to the circles of diameter $D_1$ and $D_2$, to the large side 120 of the right angle 117 and to the hypothenuse 118, 1 circle of diameter $D_4$ of the order of 1.10 mm, approximately tangential to the circle of diameter $D_3$, to the large side 120 of the right angle 117 and to the hypothenuse 118.

Similarly, in the non-limitative illustrated example, the dimples 116 define, by their intersection with the spherical peripheral surface 2 of the ball of diameter of the order of 42.67 mm, circles distributed in the following manner in each elemental surface 114:

1 circle of diameter $D_5$ of the order of 1.88 mm, positioned in the right angle 121 and approximately tangential to the two sides 120 and 123 of the right angle 121, 1 circle of diameter $D_6$ of the order of 2.42 mm, approximately tangential to the circle of diameter $D_5$, to the small side 120 of the right angle 121 and to the hypothenuse 122, 1 circle of diameter $D_7$ of the order of 2.65 mm, approximately tangential to the circles of diameters $D_5$ and $D_6$, to the large side 123 of the right angle 121 and to the hypothenuse 122, 1 circle of diameter $D_8$ of the order of 1.21 mm, approximately tangential to the circle of diameter $D_7$, to the large side 123 of the right angle 121 and to the hypothenuse 122.

With reference to the spherical, peripheral surface 2 of the ball, each of the dimples such as 115 and 116 has in this non-limitative example a depth increasing with the diameter of its intersection with the peripheral surface 2, that is to say a depth of the order of 0.1 mm, for the dimples such as 115,116 corresponding to the mentioned circles of smallest diameter, to 0.5 mm, for the dimples such as 115 and 116 corresponding to the mentioned circles of larges diameter; as for the values of the diameters $D_1$, $D_2$, $D_3$, $D_4$, $D_5$, $D_6$, $D_7$, $D_8$, these values of depth are indicated only by way of non-limitative example.

In a general manner, the general invention is susceptible of numerous variants without departing from its scope.

I claim:

1. A golf ball comprising a peripheral surface having the general shape of a sphere and a plurality of dimples arranged in said peripheral surface and distributed on the latter in accordance with at least one repetitive motif defined by sub-division of said peripheral surface along arcs of circles centered on a center of said sphere and mutually connecting points of said peripheral surface corresponding to determined points of a cube inscribed in said sphere, said circular arcs defining elemental spherical surfaces and said dimples being essentially inside said elemental surfaces, wherein said subdivision is carried out along:

6 equatorial circles of which each is centered on an axis passing through respective mid-points of two diametrically opposed edges of said cube and passes through four apices of the latter, 3 equatorial circles of which each is centered on an axis passing through respective centers of two diametrically opposed faces of said cube and passes via radial projections, onto said sphere, of respective mid-points of 4 mutually parallel edges of said cube, 4 equatorial circles of which each is centered on an axis passing through two diametrically opposed apices of said cube and passes through radial projections, onto said sphere, of the respective mid-points of six edges, in perpendicular pairs, of said cube, in a manner to define 48 first ones of said identical elemental surfaces and 48 second ones of said elemental surfaces identical between themselves but different from said first elemental surfaces, said first and second elemental surfaces being of spherical right-angle triangle form.

2. A golf ball according to claim 1, wherein at least one determined said equatorial circle cuts none of the dimples.

3. A golf ball according to claim 2, wherein said determined equatorial circle sub-divides each of the other said equatorial circles into two circular arcs, of which each corresponds to one of two hemispheres defined by said determined equatorial circle, and said circular arcs of one of said hemispheres are angularly displaced, with respect to respectively corresponding circular arcs of the other of said hemispheres, by the same amount about an axis of said determined equatorial circle.

4. A golf ball according to claim 2, wherein none of said equatorial circles cuts one of said dimples.

5. A golf ball according to claim 1, wherein said dimples are distributed in accordance with an identical motif in said identical elemental surfaces.

6. A golf ball according to claim 5, wherein said sphere has a diameter of the order of 42.67 mm, and said dimples define by their intersection with said peripheral surface circles distributed in the following manner in each said first elemental surface of spherical right-angle triangle form, of which a right angle is situated between two sides of different length:

one circle of diameter $D_1$ of the order of 1.32 mm, positioned in said right angle and approximately tangential to said two sides of said right angle, one circle of diameter $D_2$ of the order of 1.65 mm, approximately tangential to said circle of diameter $D_1$, to a smaller one of said sides of said right angle and to a hypothenuse, one circle of diameter $D_3$ of the order of 2.00 mm, approximately tangential to said circles of diameter $D_1$ and $D_2$, to a larger one of said sides of said right angle and to said hypothenuse, one circle of diameter $D_4$ of the order of 1.10 mm, approximately tangential to said circle of diameter $D_3$, to said larger side of said right angle and to said hypothenuse.

7. A golf ball according to claim 6, wherein each said dimple has a depth of the order of 0.1 mm to 0.5 mm increasing with correspondingly increasing diameter of said circle.

8. A golf ball according to claim 5, wherein said sphere has a diameter of the order of 42.67 mm, and said dimples define by their intersection with said peripheral surface circles distributed in the following manner in each said second elemental surface in spherical right-angle triangle form, of which a right angle is situated between two sides of different lengths:

one circle of diameter $D_5$ of the order of 1.88 mm, positioned in said right angle and approximately tangential to said two sides of said right angle, one circle of diameter $D_6$ of the order of 2.42 mm, approximately tangential to said circle of diameter $D_5$, to a smaller one of said sides of said right angle and to a hypothenuse, one circle of diameter $D_7$ of the order of 2.65 mm, approximately tangential to said circles of diameter $D_5$ and $D_6$, to a larger one of said sides of said right angle and to said hypothenuse, one circle of diameter $D_8$ of the order of 1.21 mm, approximately tangential to said circle of diameter $D_7$, to said larger side of said right angle and to said hypothenuse.

9. A golf ball according to claim 1, wherein each said dimple has a shape of a spherical depression.

* * * * *